US007841043B2

(12) United States Patent
Fernandez-Grandizo Martinez et al.

(10) Patent No.: US 7,841,043 B2
(45) Date of Patent: Nov. 30, 2010

(54) LATCH ASSEMBLY FOR WET/DRY VACUUM CLEANER

(75) Inventors: Jesus Fernandez-Grandizo Martinez, Cuautitlan Izcalli (MX); Felix Rodriguez Perfino, Cuautitlan Izcalli (MX)

(73) Assignee: Koblenz Electrica S.A. de C.V., Cuautitlan Izcalli (MX)

( * ) Notice: Subject to any disclaimer, the term of this patent is extended or adjusted under 35 U.S.C. 154(b) by 1084 days.

(21) Appl. No.: 11/549,029

(22) Filed: Oct. 12, 2006

(65) Prior Publication Data

US 2007/0261182 A1 Nov. 15, 2007

Related U.S. Application Data

(60) Provisional application No. 60/747,265, filed on May 15, 2006.

(51) Int. Cl.
*A47L 5/22* (2006.01)

(52) U.S. Cl. ..... 15/327.2; 15/327.6

(58) Field of Classification Search ..... 15/1, 15/327.1, 327.2, 327.6; 403/316, 348, 349, 403/353; 417/236, 360, 423.15, 423.2
See application file for complete search history.

(56) References Cited

U.S. PATENT DOCUMENTS

| | | | | |
|---|---|---|---|---|
| 5,388,301 | A * | 2/1995 | Bosyj et al. | 15/327.1 |
| 5,404,614 | A * | 4/1995 | Stephens | 15/327.2 |
| 5,455,983 | A * | 10/1995 | Crouser et al. | 15/331 |
| 5,611,107 | A * | 3/1997 | Tomasiak et al. | 15/327.2 |
| 6,101,669 | A * | 8/2000 | Martin et al. | 15/327.2 |
| 6,807,706 | B2 * | 10/2004 | Fernandez-Grandizo Martinez | 15/327.2 |

* cited by examiner

*Primary Examiner*—Dung Van Nguyen
(74) *Attorney, Agent, or Firm*—Greenberg Traurig, LLP

(57) ABSTRACT

A latch assembly for a wet/dry vacuum cleaner wherein the vacuum has a fan collector cover disposed between the filter cage and water tank of the vacuum cleaner and the drum lid of the vacuum housing the internal vacuum operating components. The filter cage is assembled to the drum lid or power head without tooling or screws while fixing the fan collector cover in place between the filter cage and drum lid. The power head housing is also attached to the bottom cover without screws or other fasteners.

14 Claims, 6 Drawing Sheets

FIG. 2
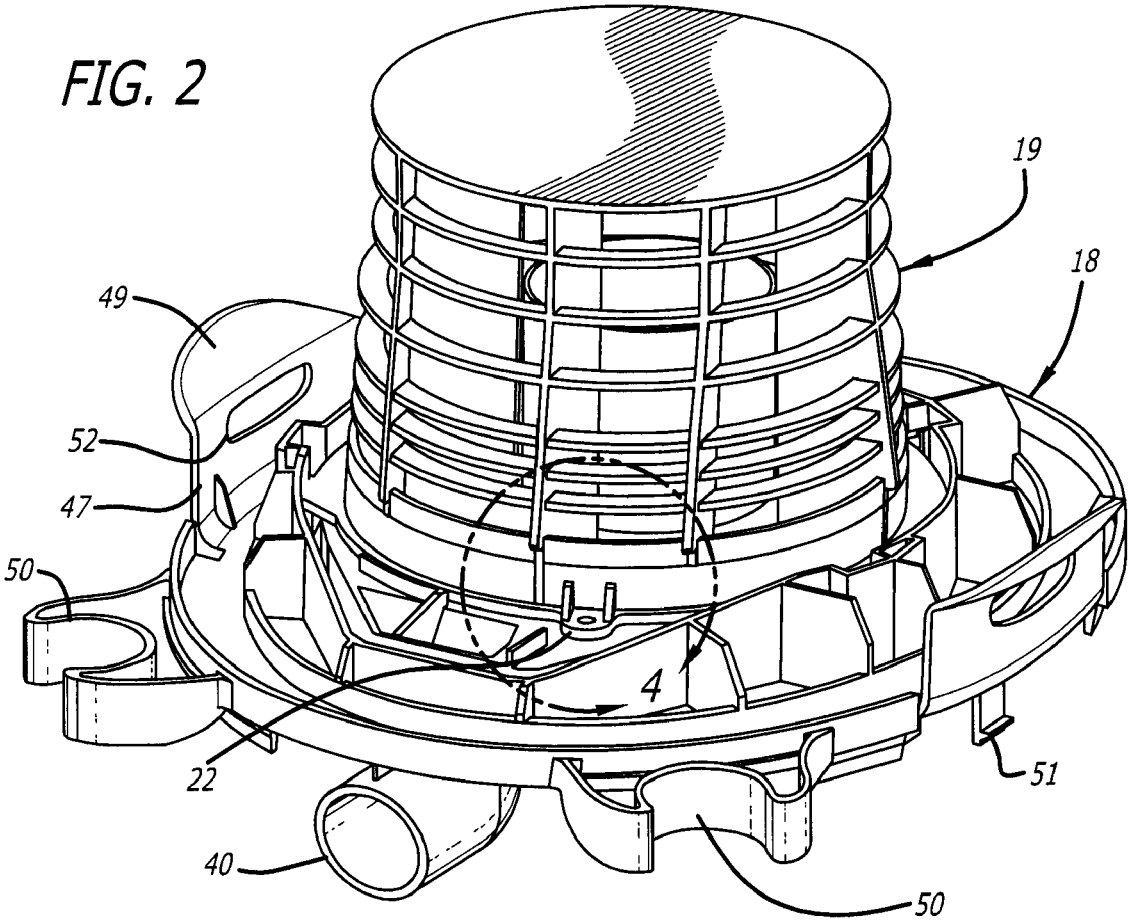
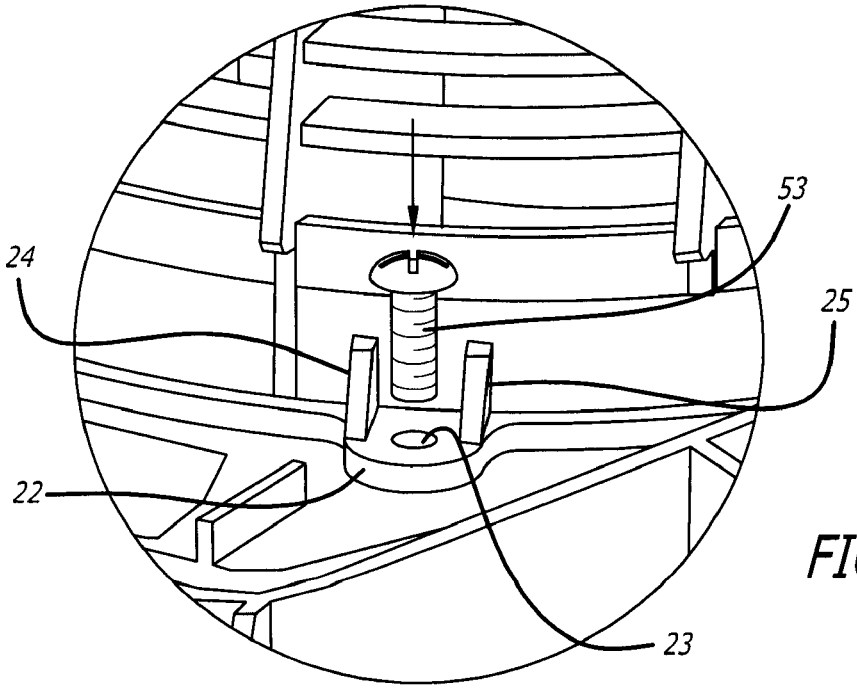
FIG. 4

LATCH ASSEMBLY FOR WET/DRY VACUUM CLEANER

RELATED APPLICATION

This application claims the benefit of and priority to U.S. Provisional Application Ser. No. 60/747,265, filed May 15, 2006, the content of which is incorporated by reference herein in its entirety.

BACKGROUND OF THE INVENTION

1. Field of the Invention

The invention relates to wet/dry vacuum cleaners, and, more particularly, to a latching assembly for latching the filter cage and fan collector cover of a wet/dry vacuum cleaner to the drum lid that is coupled to the blower housing without fasteners and to assemble and secure the cover housing to the drum lid also without screws or fasteners.

2. Related Art

Known wet/dry vacuum cleaners have fan collector housings secured to the filter housing with screws or rivets. There is a need for a quick attach-detach assembly for locking the fan collector housing to the filter housing. Such a latch mechanism must prevent leakage of water into the motor housing during wet vacuuming operation. Prior art wet/dry vacuum cleaners require fastener assemblies using screws or the like which had to be inserted through the aligned components. Such sealing means have proven unsatisfactory. Attempts to provide non-screw securing means use complicated parts that must be carefully machined.

There is a need for a latching assembly for a wet/dry vacuum cleaner that does not require screws or other fastening means wherein tools must be used to secure the components of the vacuum cleaner together.

SUMMARY

These and other objects are accomplished by providing a latch assembly for a wet/dry vacuum cleaner wherein the vacuum has a fan collector cover disposed between the filter cage and water tank of the vacuum cleaner and the drum lid housing the internal vacuum operating components. The filter cage is assembled to the drum lid or power head bottom cage holding the fan collector cover in place without screws or the like, this requiring no tooling for assembly.

BRIEF DESCRIPTION OF THE DRAWINGS

FIG. 2 is a perspective view of the filter cage of the wet/dry vacuum of FIG. 1, secured to the drum lid in accordance with the teachings of the invention;

FIG. 4 is a detailed view taken at line 4 of FIG. 2;

DESCRIPTION OF THE PREFERRED EMBODIMENT

Figure 1:
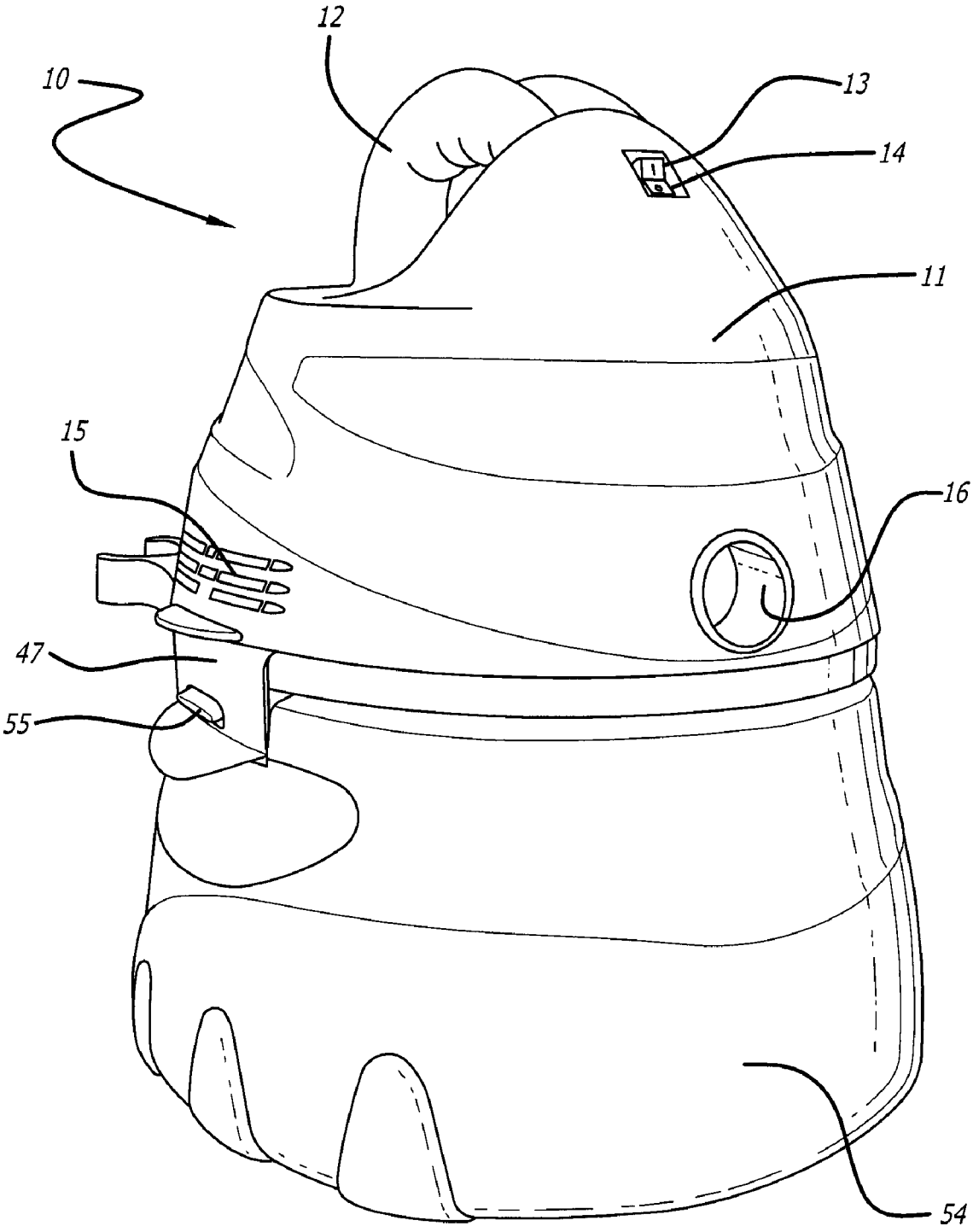
FIG. 1 is a perspective view of an assembled wet/dry vacuum in accordance with the teachings of the invention.
Figure 5:
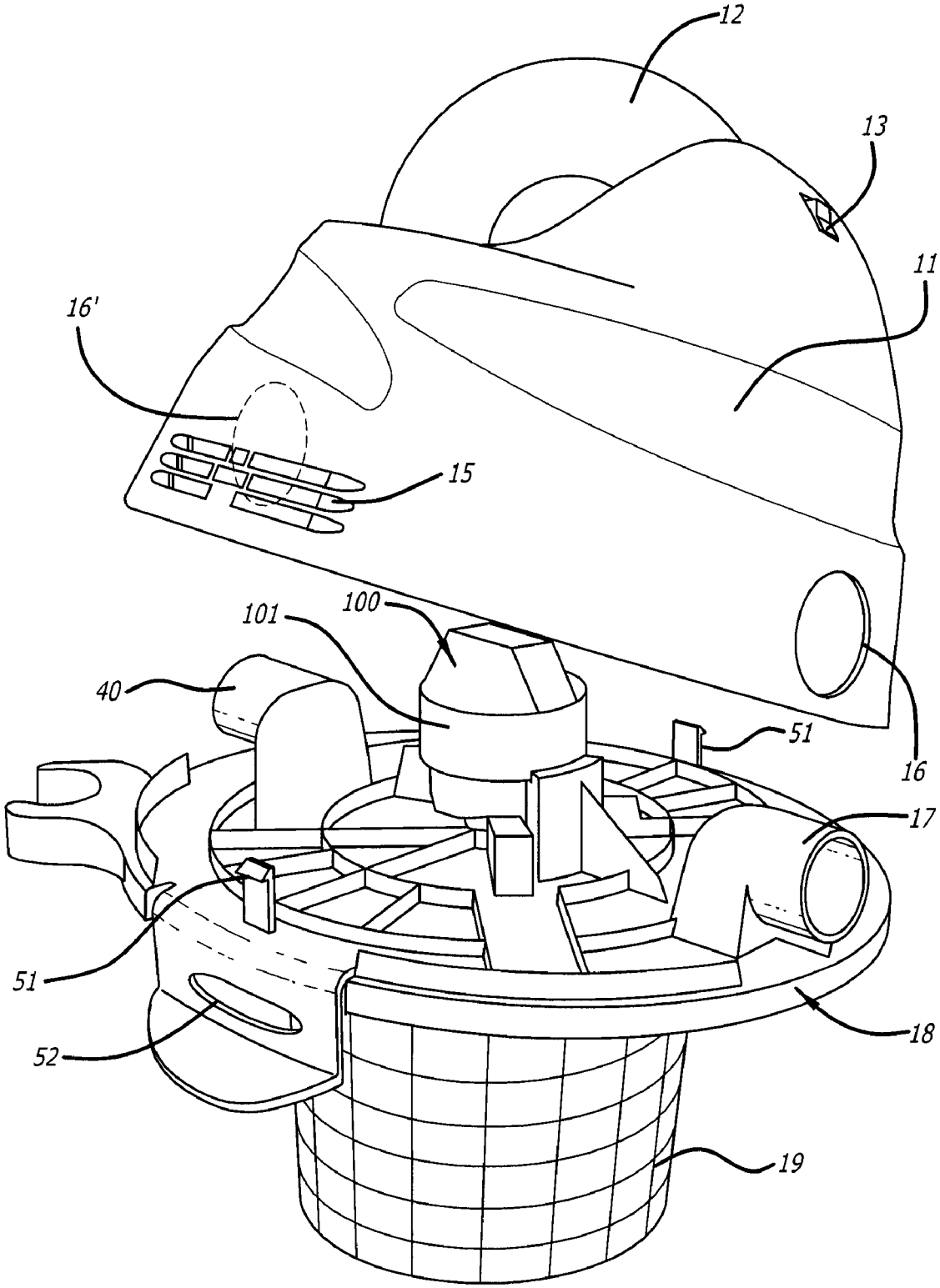
FIG. 5 is an exploded perspective view of the assembled components of FIG. 3 prior to assembly to the cover of the wet/dry vacuum of FIG. 1.

Referring now to the drawings, FIG. 1 shows an assembled wet/dry vacuum 10 having a blower (not shown) mounted internally of blower housing 11 terminating at top in a handle 12 which may be a molded part of housing 11. An on/off switch 13 is provided in an opening 14 at top of housing 11 for selectively turning the vacuum on and off. A plurality of air vents 15 are provided through the wall of housing 11 and a vacuum hole 16 is also providing through the wall of housing 11. It is thus to be understood that a conventional wet/dry vacuum motor and fan assembly 100 (FIG. 5), as is well known in the art, is disposed internally of cover 11 when assembled over drum lid 18, as is well known in the art.

Figure 9:
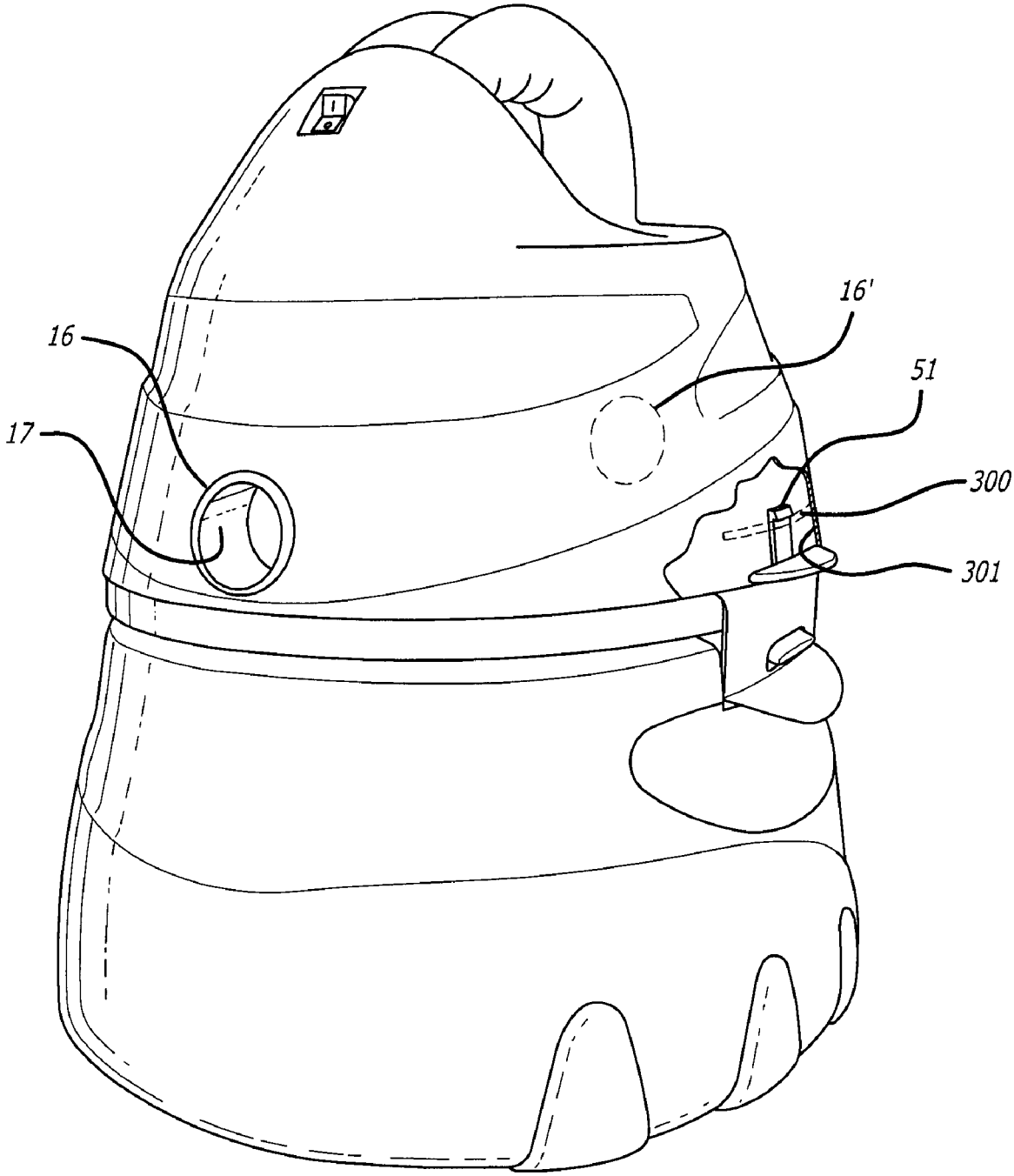
FIG. 9 is a view, similar to FIG. 1, partly in cross-section, illustrating the attachment of housing to the bottom cover without screws or other fastening means.

When cover housing 11 is assembled to the assembled components of FIG. 3, as will be discussed, the vacuum port or vacuum tube 17 aligns with, and latches to, vacuum hole 16 in housing 11. In like manner, as seen in FIG. 9, exhaust port 40 aligns with, and latches to, exhaust port or hole 16'. Thus, the interaction of tubes 17 and 40 with holes 16 and 16', respectively, act as the main latches for vacuum 10 against the holes 16 and 16' in housing 11.

Latches 51 (FIG. 5) snap onto an internal rib or ribs 300 on the inner wall 301 of housing 11. Thus, the power head housing 11 is further attached without screws to the bottom cover 18 by means of the latches 51 of FIG. 5 which engage with an internal rib or ribs 300 on the housing 11, thus acting as a secondary latching system for housing 11.

Drum lid 18 (see also FIG. 3) is shown in FIG. 2 assembled to the filter cage 19. It is to be understood that the drum lid 18 includes a conventional air intake section seen in FIG. 5, comprised of motor 101 activating a fan at top (not shown) as is well known in the art. The wiring therefor has been omitted for convenience of illustration. Filter cage 19 has an annular sealing rim 20 (FIG. 3) with a plurality of spaced latches 21. As will be discussed further hereinbelow, an apertured ear 22 is also provided on rim 20 having a hole 23 (FIG. 4) with spaced upstanding posts 24, 25 on each side of hole 23. Filter cage 19 terminates at top in a flat circular member 26 (FIG. 3) and had a plurality of vertically spaced ribs 27, extending to an annular band 28 interconnecting member 26 to rim 20. A plurality of horizontally extending flanges 29 interconnect ribs 27 thus forming an open cage for filter 19 as is well known in the art.

An inverted cup float 30, as is also well known in the art, is provided between filter cage 19 and fan collector cover 31. Cover 31 has a central opening 32 surrounded by a circular boss 33. Cup 30 fits over boss 33 and thus blocks opening 32.

When the water lever rises in the tank, the float 30 is lifted. Cover 31 is configured similarly to the open area 34 internally of bottom cover 18, the open area 34 being surrounded by an upstanding peripheral wall 35. Wall 35 is connected to the inner peripheral rim 36 of cover 18 by a plurality of spaced flanges 37. The bottom wall 38, which forms open area 34, interconnects inner rim 36 to outer wall 39.

Again, as is well known in the art, an exhaust port 40 (see FIG. 5) is also provided communicating with an opening (not shown) in cover 11 opposite opening 16.

Figure 3:
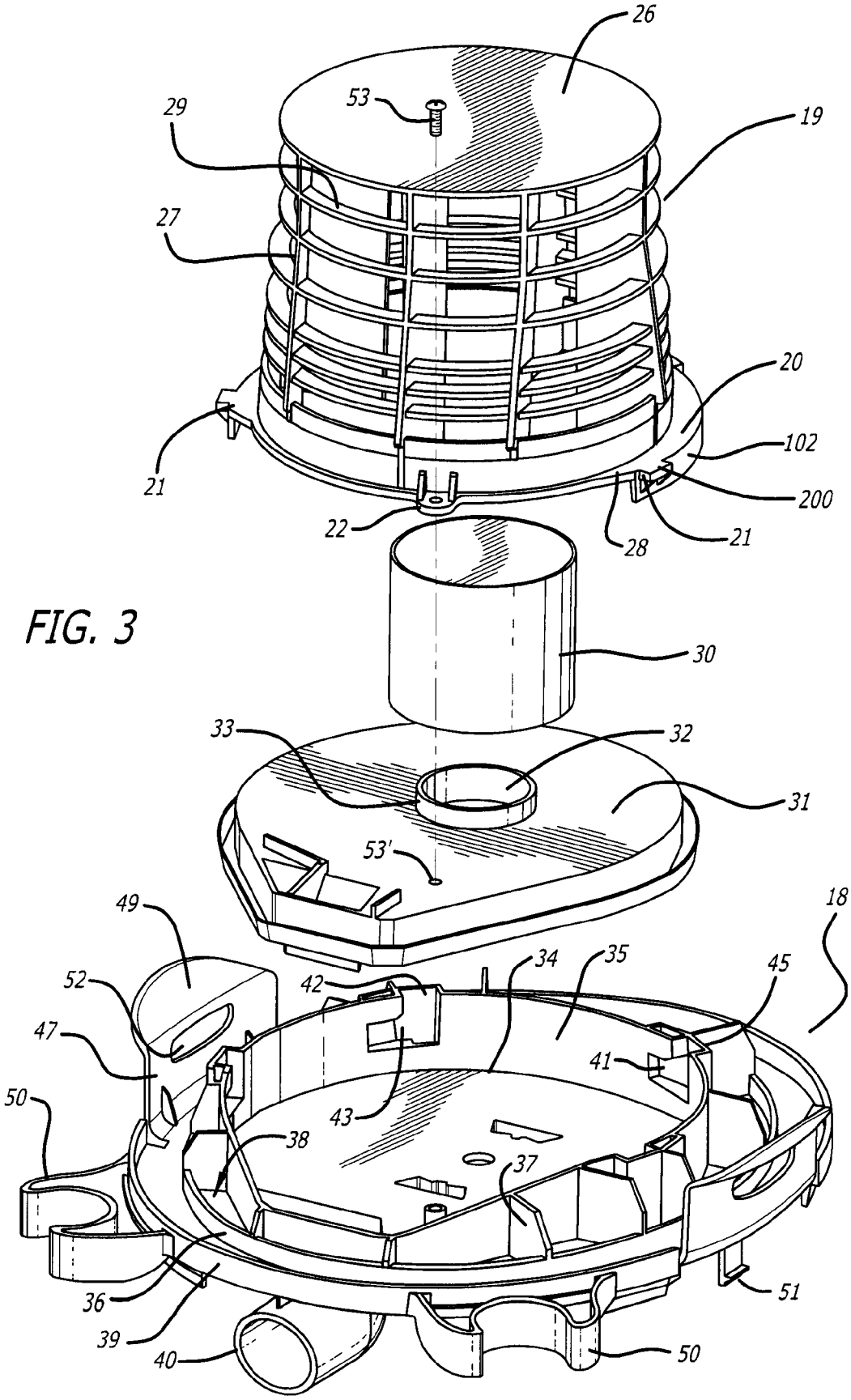
FIG. 3 is an exploded perspective view of the filter cage, drum lid, fan collector cover and float of the wet/dry vacuum of FIG. 1

As seen in FIG. 3, a plurality of L-shaped slots 41 are provided along the top of wall 35 adapted to align with a like number of protrusions or latches 21 along rim 28 of filter cage 19. As seen, each slot 41 is formed by a break or opening 42

(FIG. 6) in wall 35 communicating with a generally rectangularly shaped open area 43. Wall 35, at opening 42, has a first portion 44 extending outwardly away therefrom and generally perpendicular thereto, then integral with an outer wall portion 45 extending across opening 42 to a second portion 46 extending inwardly toward wall 35 and generally perpendicular thereto. The width of opening 42 is wider than the width of opening 43 and, thus, forms an L-shaped slot for reasons to be discussed.

A flange 47 (FIG. 3) is integral with wall 39, extending upwardly therefrom, terminating at an outwardly extending lip 49. A plurality of tool retaining members 50, integral with the exterior of wall 39, are provided at spaced locations. Each flange 47 has an opening 52 therein. A plurality of downwardly extending locking flanges 51 are provided at spaced locations along the bottom of cover 18.

As seen in FIG. 3, the first step in assembly of the parts is the placement of the fan collector cover 31 inside the open area 34 of the power head bottom cover 18. Bottom cover 18 is snap fit to cover 11 by means of tabs 51 (FIG. 5) which snap into suitable latching ribs 300 on the inner wall of cover 11, the curved wall 301 being used for alignment. Blower part 40 and vacuum part 17 align with blower hole 16' in cover 11 and a like hole 16 opposite hole 16'.

However, looking again to FIG. 3, prior to assembly of bottom cover 18 to cover 11, and after placement of fan collector cover 31 inside of bottom cover 18, float 30 is then placed over boss 32.

As particularly contemplated in the present invention, a quick and easy snap on and off release and engagement of the filter cage 19 to the power head bottom cover 18 is provided.

Figure 6:
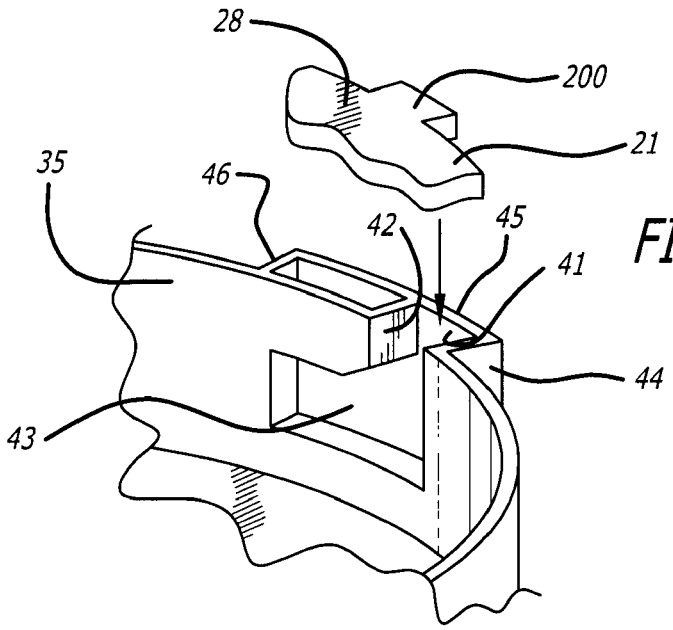
FIG. 6 is a detailed exploded view illustrating the quick lock and release feature of the invention.
Figure 7:
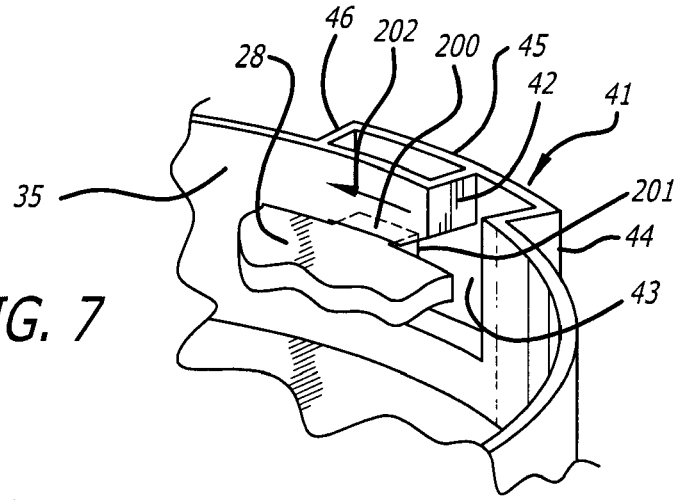
FIG. 7 is a detailed view illustrating the quick lock feature of the invention.
Figure 8:
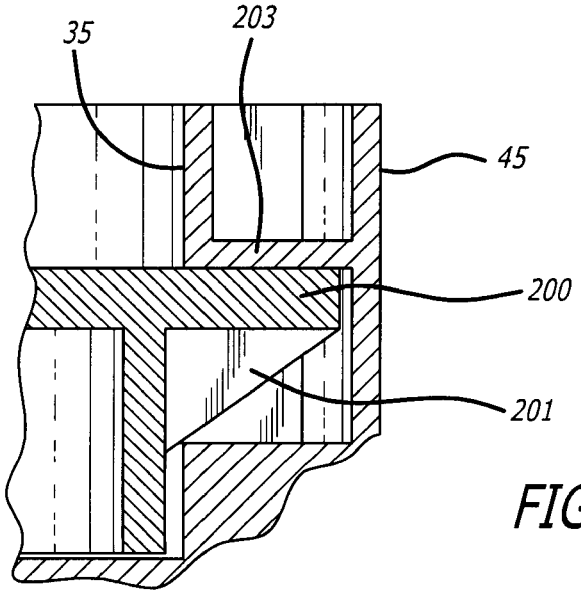
FIG. 8 is a detailed cross-sectional view of the locking tab in the locking slot of FIG. 7.

Thus, as seen in FIG. 6, each latch 21 has a tab portion 200 at top and a downwardly extending tapered portion 201, best seen in FIG. 8, triangular in cross-section. Tapered portion 201, integral with tab portion 200, extends downwardly within slot 41 (FIG. 7) past opening 42 into open area 43. By rotating filter cage 19 in the direction of arrow 202, the tab portion 200 moves under the bottom wall 203 (FIG. 8) formed between walls 45 and 35 and thus is locked in position. When it is desired to unlock filter cage 19 from engagement with bottom cover 18, filter cage 19 is moved clockwise or in the opposite direction of arrow 202 thus unlatching the filter cage 19 from engagement with bottom cover 18.

Thus, the final assembled position of all parts of vacuum 10 is shown in FIG. 1. The filter cage 19 is disposed internally in a water/dust tank and filter housing 54 having outwardly spaced tabs 55 snap fitting into openings 52 in flanges 47.

Any suitable materials may be used, such as plastic, where possible. Any suitable number, such as 4, of slots 41, may be provided in bottom cover 18. Cover 31 fits inside of bottom cover 18 and covers the fan collector chamber therein.

The operation of a conventional wet/dry vacuum is well known in the art along with their internal components. One such vacuum is disclosed in U.S. Pat. No. 6,101,669 to Martin et al. Other such vacuums are discussed in the Background of the Invention of U.S. Pat. No. 6,101,669. In many prior art wet/dry vacuums, the fan collector cover is attached to the drum lid or power head bottom cover by means of screws or rivets.

In the present application, the fan collector chamber 34 is closed by a fan collector cover 31. The cover 31 is held in place by the filter cage 19. The filter cage 19 locks to the drum lid and, when it is desired to disengage filter cage 19 from cover 18, the filter cage 19 is turned in a clockwise direction releasing latches 21 from engagement in slots 41. Thus, the fan collector cover 31 and filter cage 19 are assembled to bottom cover 18 without the use of screws or tools. Fan collector cover 31, in its assembly to cover 18, prior to engagement of filter cage 19 to cover 18, is merely placed within open area 34 guided by its configuration and the configuration of area 34. The power head housing 11 is also attached without screws on other fasteners to the bottom cover 18.

In jurisdictions where safety standards are such that a positive lock, requiring tools necessary to remove components that cover such moving parts, are the law, an optional threaded screw or bolt, such as bolt 53, and mating hole 23, may be provided.

Thus, as seen in FIG. 4, apertured flange 22 is adapted to receive a screw or bolt 53 in hole 23 which is aligned with hole 53' in cover 31 (FIG. 3).

Also, in the instant application, the fan collector cover 31 is assembled from the bottom of the drum lid or bottom cover 18 providing additional protection. If any leakage were to occur, the water would fall into the tank formed within housing 54 instead of coming into contact with live motor parts.

It can thus be seen that there is disclosed a wet/dry vacuum cleaner wherein the assembly of the fan collector cover to the drum lid is performed without the need of tooling or screws or bolts or the like. Although a particular embodiment of the invention is disclosed, variations thereof may occur to an artisan and the scope of the invention should only be limited by the scope of the appended claims.

The invention claimed is:

1. A quick release and quick attach assembly for mounting a filter cage of a wet/dry vacuum to a power head bottom cover of the wet/dry vacuum comprising:

an annular rim mounted at the bottom of said filter cage, said rim having a plurality of latches extending away from said filter cage;

said bottom cover having a central area therein receiving therein a fan collector cover closing off internal components of said bottom cover from said filter cage;

said filter cage being directly attached to said power head bottom cover and quickly releasable therefrom; and a plurality of slots aligned with said latches on said rim at spaced locations along the outer periphery of said bottom cover extending toward said rim directly receiving said latches therein in a quick release manner while fixing said fan collector cover in place within the center area of said bottom cover without any fasteners requiring tooling to release the same.

2. The assembly of claim 1 wherein said fan collector cover is loosely disposed within said central area.

3. The assembly of claim 1 wherein said rim is locked to said bottom cover by rotating said latches within said slots in a counter clockwise direction.

4. The assembly of claim 1 wherein said rim is unlocked from said bottom cover by rotating said latches within said slots in a clockwise direction.

5. The assembly of claim 1 wherein the outer periphery of said bottom cover comprises a peripheral wall surrounding said central area having said slots opening toward said rim.

6. The assembly of claim 5 wherein said bottom cover includes an upstanding wall surrounding said central area, the inner configuration of said upstanding wall conforming to the outer peripheral wall of said fan collector cover.

7. The assembly of claim 1 including a power head housing closing off the power head bottom cover, said housing snap fitting into locking engagement with said power head bottom cover without any fasteners requiring tooling to lock or release the same.

8. A quick release and quick attach assembly for mounting a filter cage of a wet/dry vacuum having a power head bottom cover to the power head bottom cover of said vacuum comprising:

an annular rim mounted at one end of said filter cage, said rim having at least one quick release interconnector extending away from said filter cage;

said bottom cover having a central area therein receiving therein a fan collector cover closing off internal components of said bottom cover from said filter cage;

said filter cage being directly attached to said bottom power head bottom cover and quickly releasable therefrom; and a plurality of quick release interconnectors aligned with said at least one first mentioned interconnector on said rim being disposed at spaced locations along the outer periphery of said bottom cover and extending toward said rim directly engaging said first mentioned at least one interconnector in a quick release manner while fixing said fan collector cover in place within the center area of said bottom cover without any fasteners requiring tooling to release the same.

9. The assembly of claim 7 wherein said fan collector cover is loosely disposed within said central area.

10. The assembly of claim 7 wherein said at least one first is a latch.

11. The assembly of claim 9 wherein said last mentioned interconnectors are slots.

12. The assembly of claim 8 including a power head housing closing off the bottom cover, said housing snap fitting into locking engagement with said bottom cover without any fasteners requiring tooling to lock or release the same.

13. A quick release and quick attach assembly for assembling a wet/dry vacuum having a filter cage coupled to a power head bottom cover comprising:

said power head bottom cover having a central area therein receiving therein a fan collector cover closing off internal components of said bottom cover, said bottom cover having a hollow vacuum tube and a hollow exhaust port communicating the interior of said bottom cover with the exterior thereof; and a power head cover housing closing off the power head bottom cover, said power head cover housing having a vacuum port and an exhaust port communicating the interior of said power head cover housing with the exterior thereof; and said exhaust port and said vacuum port aligning with the respective exhaust tube and A vacuum port on said bottom cover when said power head cover housing is assembled onto said bottom cover, said vacuum tube aligning with and latching to said vacuum port and said exhaust tube aligning with and latching to said exhaust port thereby providing a main latching assembly of said power head cover housing to said power head cover without need for any fasteners requiring tooling to lock or release the power head cover housing to said bottom cover.

14. The assembly of claim 13 wherein said power head cover housing has an interior wall and includes at least one peripheral rib extending about the interior wall and outwardly therefrom toward the center of said power head cover housing; and said bottom cover has a plurality of latches extending toward said cover housing and engaging said rib and snap fitting onto said rib to thereby provide a secondary latch in an assembly of said bottom cover to said power head cover housing.

* * * * *